US007299596B2

(12) United States Patent
Hildreth

(10) Patent No.: US 7,299,596 B2
(45) Date of Patent: Nov. 27, 2007

(54) FRAMING SYSTEM

(75) Inventor: John Hildreth, 7811 Fieldstone Ct., Ellicott City, MD (US) 21043

(73) Assignee: John Hildreth, Ellicott City, MD (US)

( * ) Notice: Subject to any disclaimer, the term of this patent is extended or adjusted under 35 U.S.C. 154(b) by 313 days.

(21) Appl. No.: 10/828,350

(22) Filed: Apr. 21, 2004

(65) Prior Publication Data

US 2005/0235594 A1 Oct. 27, 2005

(51) Int. Cl.
*E04C 3/02* (2006.01)

(52) U.S. Cl. ..... 52/695; 52/693; 52/656.1; 52/696; 52/731.1

(58) Field of Classification Search ..... 52/693, 52/695, 653.1, 656.1, 696, 731.1, 731.5, 52/731.9, 800.12, 800.15, 800.17
See application file for complete search history.

(56) References Cited

U.S. PATENT DOCUMENTS 3,608,259 A * 9/1971 Iwens ..... 52/263
5,657,606 A * 8/1997 Ressel et al. ..... 52/690
5,664,388 A * 9/1997 Chapman et al. ..... 52/653.1
5,729,950 A * 3/1998 Hardy ..... 52/693
6,014,843 A * 1/2000 Crumley et al. ..... 52/167.3
6,067,769 A * 5/2000 Hardy ..... 52/693
6,185,898 B1 * 2/2001 Pratt ..... 52/657
6,892,504 B1 * 5/2005 diGirolamo et al. ..... 52/657
6,920,724 B1 * 7/2005 Hundley ..... 52/167.3
6,941,718 B1 9/2005 diGirolamo et al.

* cited by examiner

*Primary Examiner*—Jeanette Chapman
(74) *Attorney, Agent, or Firm*—DLA Piper US LLP

(57) ABSTRACT

A framed shear wall has a pair of crossed tension straps passing through the studs that make up the shear wall. The straps are preferably rods and are preferably attached to upstanding plates installed at the corners of the wall. Each of two straps is preferably attached to an opposite side of the upstanding plate such that the straps do not interfere with each other where the straps cross. The straps preferably include threaded ends and the upstanding plates preferably have threaded receptacles sized to accept the threaded ends of the straps such that the straps can be tensioned before and/or after installation. In one embodiment, the upstanding plates are bolted through a bottom surface of the wall into a threaded anchor plate at floor level, and the threaded anchor plate is attached to a top of a wall on a floor below.

11 Claims, 5 Drawing Sheets

FRAMING SYSTEM

BACKGROUND OF THE INVENTION

1. Field of the Invention

The invention relates to framing systems generally, and more particularly to light gauge framing systems.

2. Discussion of the Background

Light gauge framing, especially light gauge steel framing, is becoming an increasingly popular alternative to wood framing in both residential and commercial construction. Structures built with light gauge framing, like other structures, must resist natural forces such as windstorms and earthquakes. "Shear elements" is the name given to elements of the structure that resist these forces. In light gauge framing, the shear elements are typically shear walls.

Shear walls are typically constructed by either 1) applying a strong panel product such as plywood on the outside of a wall framed with light gauge elements, or 2) applying a tension strap to the outside of such a light gauge framed wall (as used herein, "framed wall" refers to a wall constructed with spaced-apart studs). The requirement for a strong panel material such as plywood in the first method is undesirable because these panel materials cost more than alternative, lower strength panel materials. The second method of applying tension straps to the outside of the framed wall is undesirable for at least two reasons. First, applying tension straps on the exterior (either the inward or outward facing side) of a framed wall interferes with materials (e.g., drywall or plywood) placed over the straps. Second, installing the straps can be problematic. On the one hand, if the straps are installed before the wall is in place, the wall cannot be adjusted to account for on-site conditions. Alternatively, if the straps are installed after the wall is in place, the straps are often simply screwed or tack-welded in place without being under tension. This results in a fairly large displacement before the straps have any effect, thereby decreasing the effectiveness of the straps.

What is needed is an improved method for constructing a light gauge shear wall that can be easily manufactured and installed in a structure and that does not interfere with subsequently installed construction materials.

SUMMARY

The present invention meets the aforementioned need to a great extent by providing a framed shear wall having a pair of crossed tension straps passing through the studs that make up the shear wall. The straps are preferably rods or cables and are preferably attached to upstanding plates installed at the corners of the wall. In highly preferred embodiments, each of two straps is attached to an opposite side of the upstanding plate such that the straps do not interfere with each other (i.e., one strap does not cause a deflection in the other strap) where the straps cross. The straps preferably include threaded ends and the upstanding plates preferably have threaded receptacles sized to accept the threaded ends of the straps such that the straps can be tensioned before and/or after installation.

In one embodiment of the invention, the upstanding plates are bolted through a bottom surface of the wall into a threaded anchor plate at floor level. Preferably, the threaded anchor plate is welded to a top of a wall on a floor below. In highly preferred embodiments, the threaded plate is welded to the top of the wall on the floor below before the wall below is installed, and flooring materials (e.g., concrete) are installed around the threaded plate. In this way, a wall above such a floor can be installed by simply bolting the wall to the threaded plate.

BRIEF DESCRIPTION OF THE DRAWINGS

A more complete appreciation of the invention and many of the attendant features and advantages thereof will be readily obtained as the same become better understood by reference to the following detailed description when considered in connection with the accompanying drawings, wherein.

DETAILED DESCRIPTION

The present invention will be discussed with reference to preferred embodiments of light gauge framed shear walls. Specific details are set forth in order to provide a thorough understanding of the present invention. The preferred embodiments discussed herein should not be understood to limit the invention. Furthermore, for ease of understanding, certain method steps are delineated as separate steps; however, these steps should not be construed as necessarily distinct nor order dependent in their performance.

Figure 1:
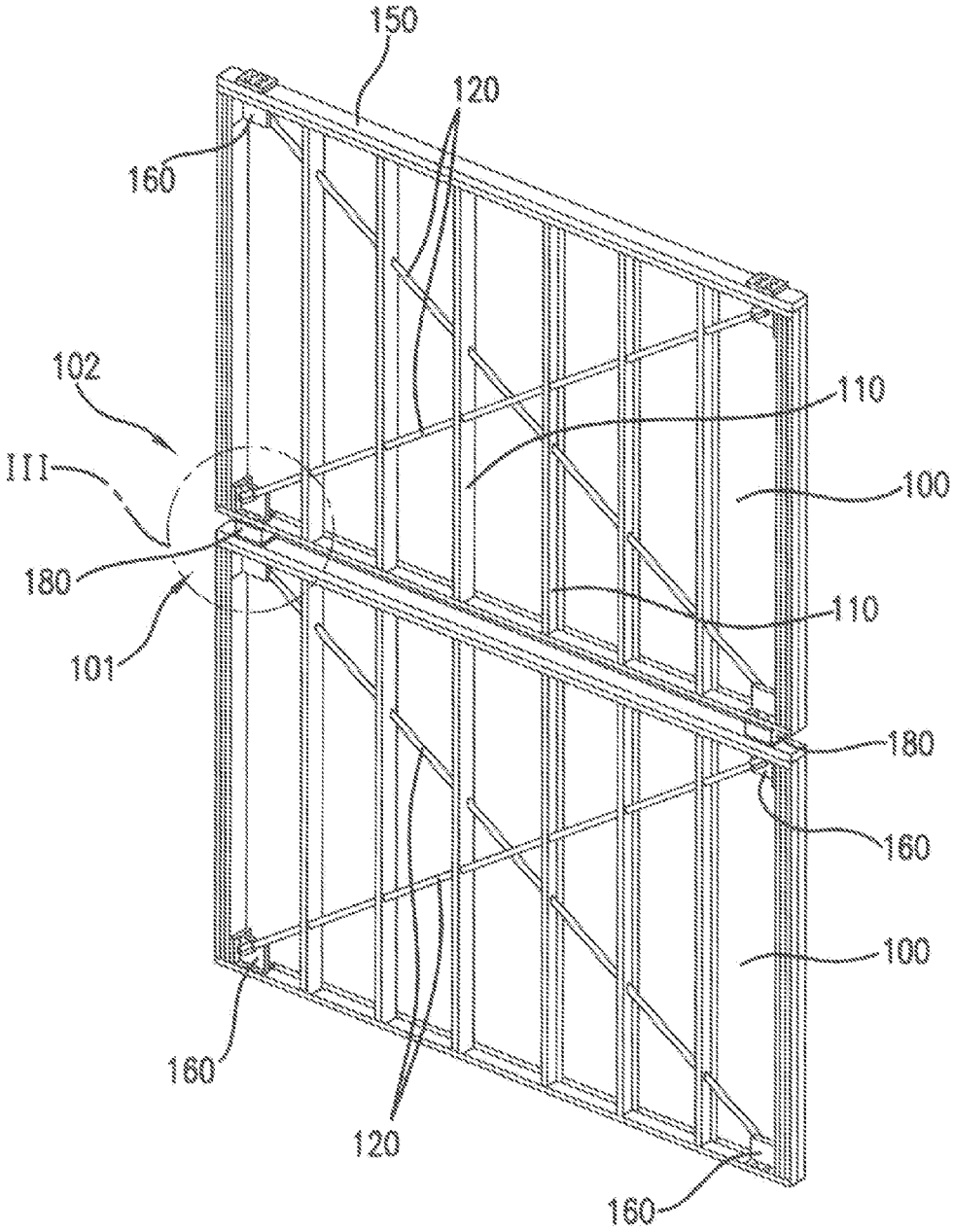
FIG. 1 is a perspective view of two connected shear wall according to a preferred embodiment of the invention.
Figure 2:
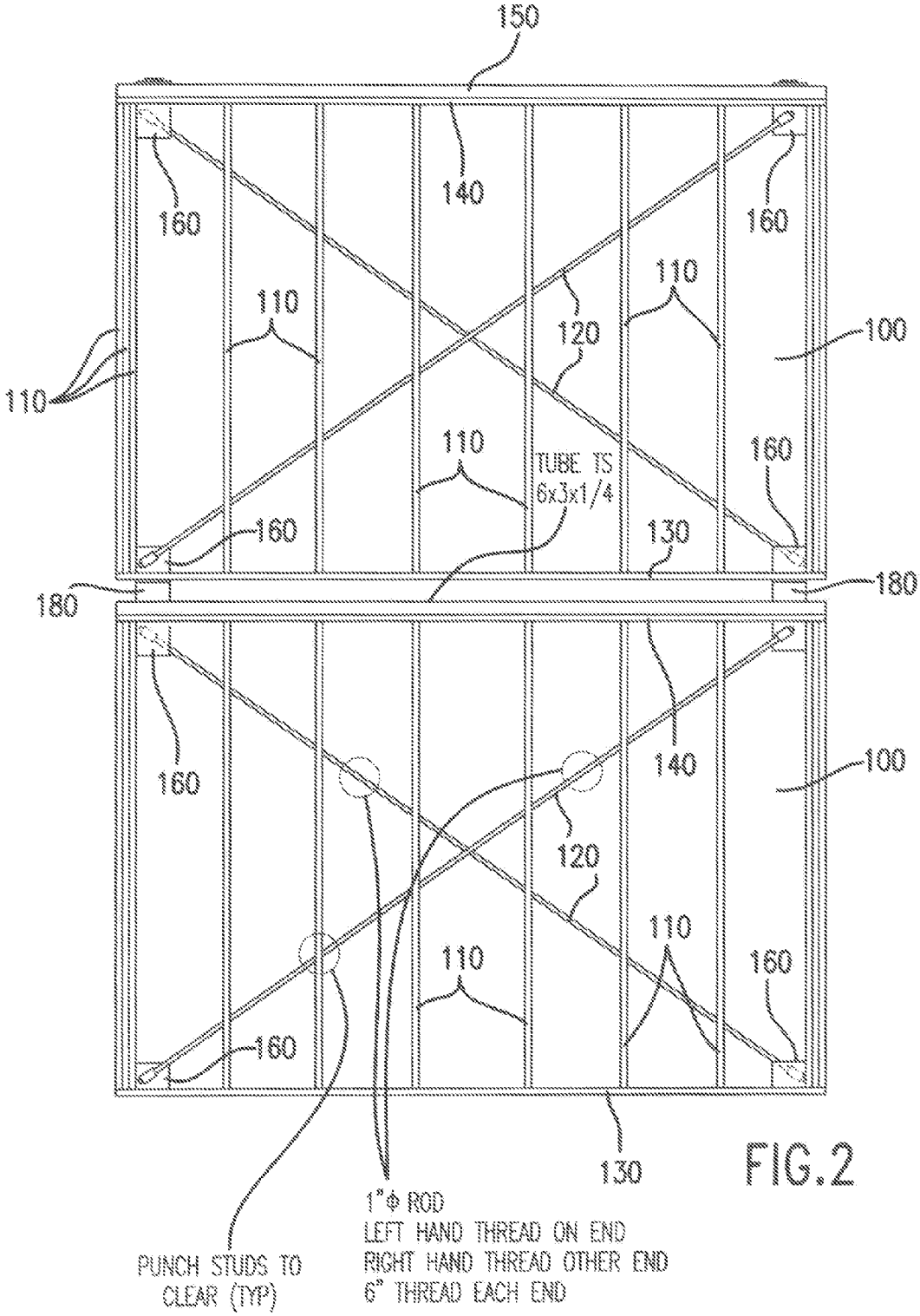
FIG. 2 is a side view of the shear walls of FIG. 1.

FIG. 1 is a perspective view and FIG. 2 is a side view of two attached shear walls 100 according to a preferred embodiment of the present invention. Each of the shear walls 100 comprises a plurality of vertically oriented, spaced-apart studs 110. Three studs 110 are ganged together at the sides of each of the walls 100 for added strength. The studs 110 are connected by a bottom channel 130 and a top channel 140. A hollow rectangular member 150 is installed on the top face of the top channel 150 opposite the side of the channel 150 that accepts the studs 110.

Each of the walls 110 also includes two crossed rods 120 attached to upstanding plates 160 on opposite corners of the wall 100. The crossed rods 120 provide shear strength to the walls 100 and perform the function of the panel or straps in conventional shear walls. The rods 120 pass through holes in each of the studs 110 such that the rods are positioned entirely in the interior of the walls 100 such that no portion of the rods 110 extend past either the front or rear faces of the studs 110 or channels 130, 140. This allows materials such as drywall or paneling to be attached to the walls 100 without interference from the rods 120.

Figure 3:
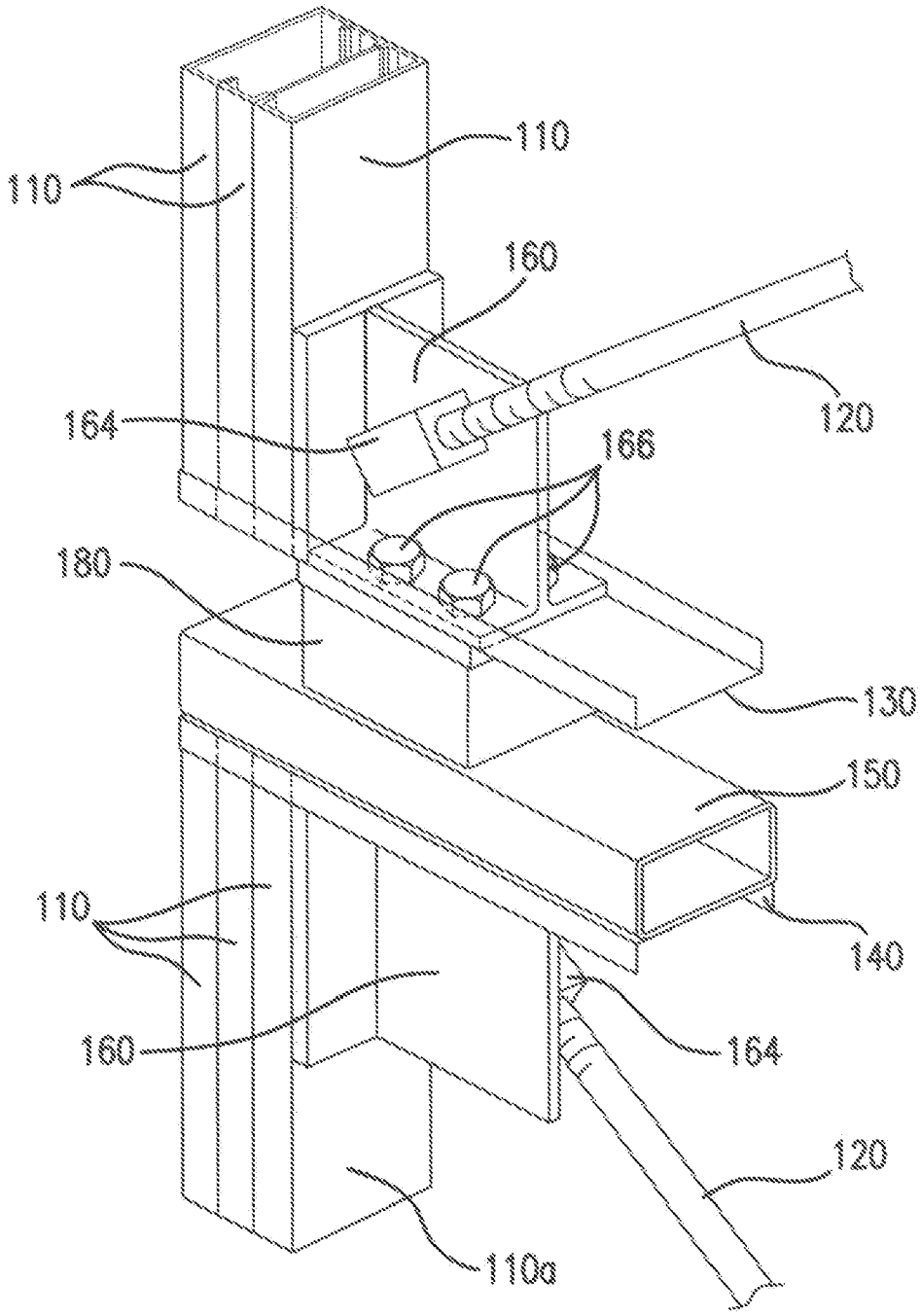
FIG. 3 is a perspective view of a corner interconnection between the shear walls of FIGS. 1 and 2.
Figure 4:
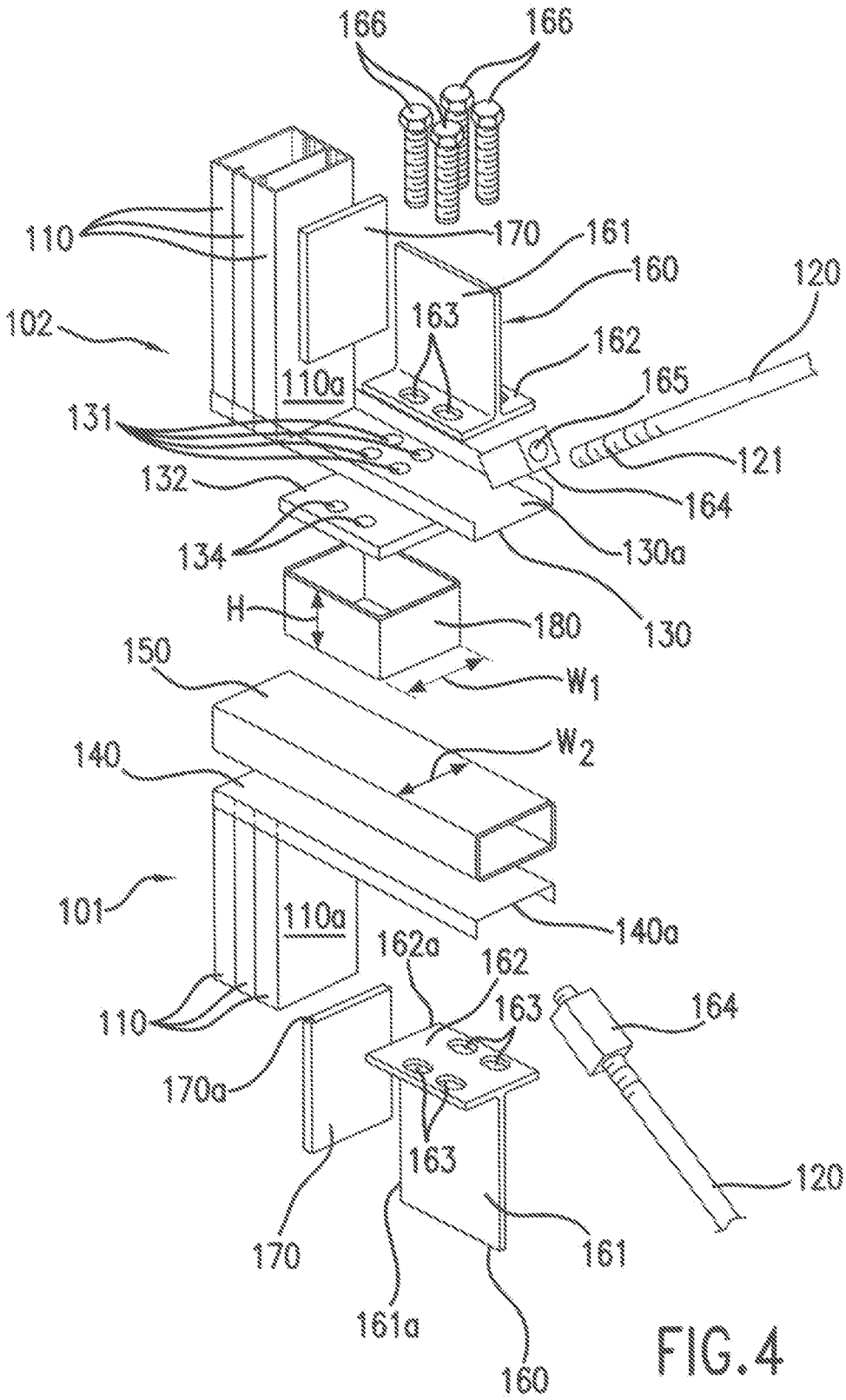
FIG. 4 is a perspective exploded view of the corner interconnection of FIG. 3.

A perspective view of an upper corner 101 and a lower corner 102 of the connected walls 100 of FIGS. 1 and 2 is illustrated in FIG. 3, and an exploded perspective view of these corners 101, 102 is illustrated in FIG. 4. The upper corner 101 is reinforced by a T plate 160 formed by a base plate 162 and an upstanding plate 161. The base plate 162 of the T plate 160 is positioned in the channel 140. A face plate 170 is preferably welded to an interior face 110*a* of the innermost stud 110, with the upper surface 170*a* of the face plate 170 welded to the upper surface 140*a* of the channel 140. The interior edge 161*a* of the upstanding plate 161 and the interior edge 162*a* of the base plate 162 are preferably welded to the face plate 170, with the base plate 162 also welded to the top surface 140*a* of the channel 140. The base plate 162 of the upper corner 101 is shown with a plurality of holes 163. These holes are not necessary when the T plate 160 is installed in an upper corner 101 (the holes 163 are necessary when the T plate 160 is used in a lower corner as will be discussed below) and thus may be omitted if desired. In preferred embodiments, the T plate 160 and the face plate 170 are welded in the corner 101 prior to installation and preferably at the factory.

The upstanding plate 161 of the T plate 160 also includes a block 164 with a female threaded hole 165 sized to accept a threaded end 121 of rod 120. Opposite ends of any rod 120 are threaded in the opposite directions (i.e., one end is right-hand threaded and the opposite end is left-hand threaded) and blocks 164 in corresponding corners are threaded to match the end 121 of the rods 120. This is done so that when the rod is rotated, the blocks 164 on opposite ends of the rod 120 are either drawn in to increase tension on the rod 120 or pushed outward to release tension on the rod 120 depending on the direction in which the rod 120 is rotated. The blocks 164 are also preferably welded to the upstanding plate 160 in both the upper and lower corners 101, 102 prior to installation and more preferably at the factory.

A rectangular member 150 is preferably welded to the top of the upper channel 140. The rectangular member 150 provides increased rigidity to the top of upper channel 140, which is especially desirable where a floor such as a concrete floor will be cast in place on top of the lower wall 110. The rectangular member 150 is also preferably welded to the upper channel 140 prior to installation and preferably at the factory.

The upper and lower corners 101, 102 are separated by a rectangular spacer 180 with a width $W_1$ sized to match a width $W_2$ of the rectangular member 150. The height H of the spacer 180 is chosen to match a thickness of a floor to be installed between the walls 100. The floor may be any material, and is most often concrete. The spacer 180 is also preferably attached to rectangular member 150 prior to installation and preferably at the factory.

Figure 5:
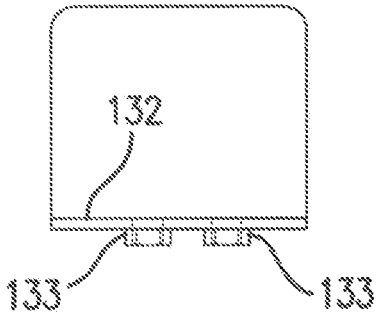
FIG. 5 is a side view of a T plate of one of the corners of the walls of FIGS. 1-4.
Figure 6:
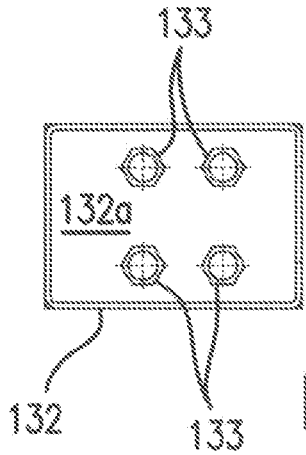
FIG. 6 is a bottom view of the T plate of FIG. 5.

An anchor plate 132 is attached to the top of the spacer 180. A side view of the anchor plate 132 and a bottom view of the anchor plate 132 are shown in FIGS. 5 and 6, respectively. The anchor plate 132 includes four holes 134. Threaded nuts 133 aligned with each of the holes 131 are welded to a bottom surface 132*a* of the anchor plate 132. The holes 134 and nuts 133 are positioned such that they can be fitted inside the spacer 180. The anchor plate 132 is preferably welded to the spacer 180 before the wall 100 is installed, and more preferably still at the factory. Thus, in preferred embodiments, the a wall 110 leaves the factory with a rectangular member 150 welded to the top of channel 140 and with a T plate 160 with block 164, a face plate 170, a spacer 180 and an anchor plate 132 all welded in the positions described above at each of the upper corners 101 at the factory.

The lower corner 102 of the wall 110 is also reinforced with a T plate 160 and a face plate 170 installed in the similar manner as the upper corner 101. That is, the base plate 162 of the T plate 160 is welded to the upper interior surface 130*a* of the lower channel 130 and to the face plate 170, and the face plate 170 is welded to an inside face 110*a* of an interior corner stud 110 and the interior upper surface 130*a* of the channel 130. Like the lower corner 101, the T plate 160 and the face plate 170 are preferably welded prior to installation of the wall 100 and more preferably at the factory. Unlike the T plate 160 in the upper corner 101, it is necessary for the T plate 160 in the lower corner 102 to have holes 163 formed in base plate 162. The lower channel 130 also has a plurality of holes 131 in positions corresponding to the holes 163 in the base plate 162.

The threaded ends 121 of the rods 120 are also preferably inserted into the blocks 164 of the T plates 160 at the factory in both the upper corner 101 and the lower corner 102, although they are preferably not under tension. Alternatively, the rods 120 may be installed at the work site. Each of the interior studs 110 has two holes formed therein, one for each of the crossed rods 120 as shown in FIG. 1. The blocks 164 of T plates 160 are positioned on opposite sides of the upstanding plates 161 on T plates on opposite sides of the wall 100. That is, the blocks 164 on the upper left hand and lower right hand corners of a wall 100 are on the same side of their respective upstanding plates 161, and the upper right hand and lower left hand corners of the same wall 100 have their blocks 164 on the opposites sides of upstanding plate 161 as shown in FIGS. 3 and 4. In this fashion, the two rods 120 are in parallel spaced apart planes and do not cause any deflection in each other even though they are both within the interior of the wall 100.

Figure 7:
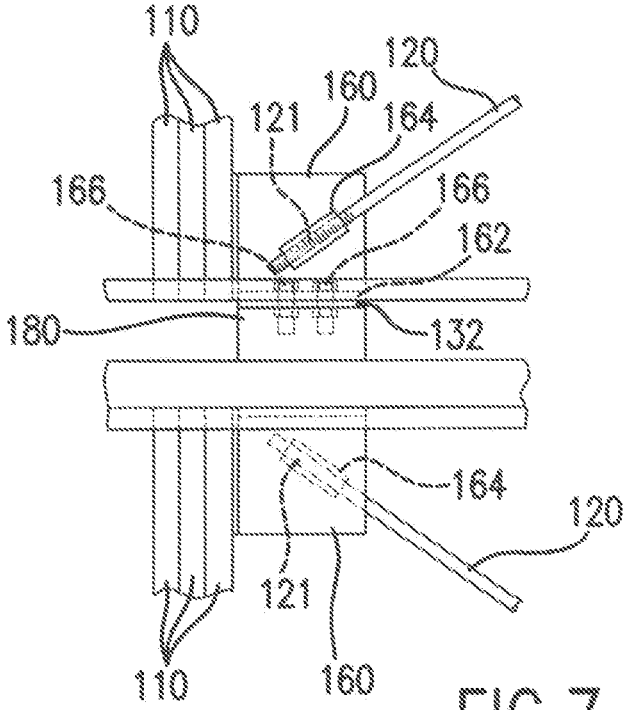
FIG. 7 is a side view of the corner interconnection of FIG. 3.

With each of the walls 100 configured in the preferred manner described above, installation is greatly simplified. When walls 100 on a lower floor have been installed, the spacers 180 and anchors 132 protrude above the rectangular member 150. Next, a floor is installed such that the top surface is at the height of the top of the anchor plate 132. When the floor is concrete, the concrete is simply screeded to the top of the anchor plate 132. Once the floor is installed, the walls corresponding to that floor are simply placed in the desired location and secured to the anchor plates 132 with a plurality (4 are used in preferred embodiments) of bolts 166. As shown in FIG. 7, the bolts 166 extend through holes 163 in the base plate 162, the holes 131 in the lower channel 130, the holes 133 in the anchor plate 132, and into the threaded nuts 133. The rods 120 are then adjusted to the desired tension and the walls 100 are then ready for drywall or other desired finishing materials. This allows for very fast construction as compared to other methods. In addition, the rods 120 are at tension and are contained within the interior of the walls 100 so as not to interfere with the installation of drywall, plywood or other materials attached to the exterior surfaces of the walls 100.

Those of skill in the art will recognize that it is not necessary for the anchor plates 132 to be attached to walls on the floor below and that the anchor plates 132 can simply be attached to a floor below. Alternatively, the walls 100 may be attached to the floor without the use of anchor plates 132. For example, when the walls 100 are installed over wood flooring, screws may be used in place of the bolts 166. As another example, when the walls are installed over concrete floors, anchor upstanding sill bolts may be cast in place in the concrete floor in positions such that they correspond to the holes 163 in the base plate 162 of T plate 160 and the walls 100 may be secured in place using nuts threaded onto the sill bolts.

It should also be noted that rods having turnbuckles are used rather than threaded rods and threaded mating blocks in some embodiments of the invention. This allows the rods (or cables) to be fixedly attached to the corners of the wall and be tensioned through adjustment of the turnbuckle.

Obviously, numerous other modifications and variations of the present invention are possible in light of the above teachings. It is therefore to be understood that within the scope of the appended claims, the invention may be practiced otherwise than as specifically described herein.

What is claimed is:

1. A shear wall comprising:

an upper channel;

a lower channel;

a plurality of spaced-apart studs connected between the upper channel and the lower channel, the plurality of studs including a first stud connected to the upper channel near a first end of the upper channel to form a first corner and connected to the lower channel near a first end of the lower channel to form a second corner, a second stud connected near a second end of the upper channel to form a third corner and near a second end of the lower channel to form a fourth corner, and a plurality of interior studs spaced between the first and second studs, each of the interior studs having at least two holes formed therein and having a front face and a rear face;

a first rod connected to the wall near the first and fourth corners; and a second rod connected to the wall near the second and third corners;

wherein each of the first and second rods pass through one of the two holes in each of the interior studs such that neither the first rod nor the second rod extend past the front face or the rear face of any interior stud; and wherein each end of the first and second rods is attached to an upstanding plate at each of the four corners of the wall with blocks corresponding to the first rod being attached to a first side of a respective upstanding plate and blocks corresponding to the second rod are attached to an opposite side of a respective upstanding plate such that the first and second rods do not interfere with each other where they cross.

2. The shear wall of claim 1, wherein the studs and channels are made from steel.

3. The shear wall of claim 1, wherein each upstanding plate is integrally formed with a base plate to form a T plate.

4. The shear wall of claim 1, wherein each end of the rods is threaded, and wherein a first end of each rod has a right hand thread, a second end of each rod has a left hand thread, and wherein each upstanding plate has a block attached to it, the block having a hole threaded to mate with a respective threaded end of a rod.

5. The shear wall of claim 1, further comprising a first anchor plate connected to a top of the wall near the first corner and a second anchor plate connected to the top of the wall near the third corner.

6. The shear wall of claim 5, wherein each of the anchor plates has a plurality of threaded holes formed therein.

7. The shear wall of claim 6, wherein the threaded holes formed in the anchor plate are formed by welding a threaded nut to the anchor plate.

8. The shear wall of claim 5, further comprising a first hollow spacer connected between the wall and an anchor plate near the first corner and a second hollow spacer connected between the wall and an anchor plate near the second corner.

9. The shear wall of claim 1, wherein at least one of the rods includes a turnbuckle, whereby the rod may be tensioned by adjusting the turnbuckle.

10. A light gauge steel shear wall comprising:

an upper channel;

a lower channel;

a plurality of spaced-apart studs connected between the upper channel and the lower channel, the plurality of studs including a first set of ganged studs connected at one end to a first end of the upper channel to form a first corner and connected at an other end to a first end of the lower channel to form a second corner, a second set of ganged studs connected at one end to a second end of the upper channel to form a third corner and connected at an other end to a second end of the lower channel to form a fourth corner, and a plurality of interior studs in a spaced apart relationship between the first and second studs, each of the interior studs having two holes formed therein and having a front face and a rear face;

a T plate near each of the first, second, third and fourth corners, each of the T plates comprising integrally formed base plates and upstanding plates, the base plates being positioned inside respective channels, each of the upstanding plates including a block having a threaded hole, each threaded hole having a thread in a direction opposite of a direction of a thread in a threaded hole in a diagonally opposite corner, threaded blocks in diagonally opposite corners being positioned on a same side of respective upstanding plates, the same side being opposite a side of the upstanding plate on which blocks are attached in other corners;

a first rod with threaded ends mated to blocks in the first and fourth corners; and a second rod with threaded ends mated to blocks in the second and third corners;

wherein the first and second rods do not interfere with each other where they cross, and wherein each of the first and second rods pass through one of the two holes in each of the interior studs such that neither the first rod nor the second rod extend past the front face or the rear face of any interior stud.

11. A light gauge steel shear wall comprising:

an upper channel;

a lower channel;

a plurality of spaced-apart studs connected between the upper channel and the lower channel, the plurality of studs including a first set of ganged studs connected at one end to a first end of the upper channel to form a first corner and connected at an other end to a first end of the lower channel to form a second corner, a second set of ganged studs connected at one end to a second end of the upper channel to form a third corner and connected at an other end to a second end of the lower channel to form a fourth corner, and a plurality of interior studs in a spaced apart relationship between the first and second studs, each of the interior studs having two holes formed therein and having a front face and a rear face;

a T plate near each of the first, second, third and fourth corners, each of the T plates comprising integrally formed base plates and upstanding plates, the base plates being positioned inside respective channels, each of the upstanding plates including a block having a threaded hole, each threaded hole having a thread in a direction opposite of a direction of a thread in a threaded hole in a diagonally opposite corner, threaded blocks in diagonally opposite corners being positioned on a same side of respective upstanding plates, the same side being opposite a side of the upstanding plate on which blocks are attached in other corners;

a first rod with threaded ends mated to blocks in the first and fourth corners;

a second rod with threaded ends mated to blocks in the second and third corners;

a hollow rectangular member welded to a top surface of the upper channel;

a first spacer attached to the hollow rectangular member at the first corner;

a second spacer attached to the hollow rectangular member at the third corner;

a first anchor plate attached to the first spacer; and a second anchor plate attached to the second spacer;

wherein each of the first and second rods pass through one of the two holes in each of the interior studs such that neither the first rod nor the second rod extend past the front face or the rear face of any interior stud; and wherein each of the anchor plates has a plurality of holes formed therein and a plurality of nuts attached thereto, one of the plurality of nuts being attached to the anchor plate at a location corresponding to one of the plurality of holes such that a bolt may pass through the hole to mate with the nut.

* * * * *